United States Patent [19]

Schultz et al.

[11] Patent Number: 4,743,311

[45] Date of Patent: May 10, 1988

[54] METHOD OF PRODUCING A METALLIC PART

[75] Inventors: Ludwig Schultz, Bubenreuth; Karl Wohlleben, Erlangen, both of Fed. Rep. of Germany

[73] Assignee: Siemens Aktiengesellschaft, Berlin and Munich, Fed. Rep. of Germany

[21] Appl. No.: 894,929

[22] Filed: Aug. 8, 1986

[30] Foreign Application Priority Data

Aug. 13, 1985 [DE] Fed. Rep. of Germany ..... 3529019

[51] Int. Cl.[4] ..... H01F 1/02

[52] U.S. Cl. ..... 148/103; 148/104; 148/105; 148/108

[58] Field of Search ..... 148/103, 104, 105, 108; 419/23

[56] References Cited

U.S. PATENT DOCUMENTS 4,144,105 3/1979 Gaiffi et al. ..... 148/103
4,197,146 4/1980 Frischmann ..... 148/103

FOREIGN PATENT DOCUMENTS

84/02926 8/1984 PCT Int'l Appl. .

OTHER PUBLICATIONS

*Scientific American,* vol. 234, No. 5, May 1976, pp. 40–48, "Mechanical Alloying", by J. S. Benjamin.

*Chemical Abstracts,* vol. 103, No. 18, Nov. 4, 1985, p. 258, 146026e.

*Appl. Phys. Lett.,* vol. 43, No. 11, Dec. 1, 1983, pp. 1017–1020, "Preparation of Amorphous $Ni_{60}Pd_{40}$ by Mechanical Alloying", by C. C. Koch et al.

*Machine Design,* vol. 55, No. 25, Oct. 10, 1983, p. 8, "New Method for Making Amorphous Metals".

*Phys. Rev. Lett.,* vol. 51, No. 5, Aug. 1, 1983, pp. 415 to 418, "Formation of an Amorphous Alloy by Solid-State Reaction of the Pure Polycrystalline Metals", by Schwarz et al.

*J. of Non-Crys. Sol.,* vol. 61/62, 1984, pp. 817 to 822, "Amorphous Zirconium-Nickel Films Formed by Solid State Reactions", by Clemens et al.

*Proc. MRS Europe Meeting on Amorphous Metals,* 1984, pp. 135–140, "Preparation of Thick Amorphous Metals by Jelly Roll Technique and Rapid Diffusion", by L. Schultz.

*Appl. Phys. Lett.,* vol. 44, No. 1, Jan. 1, 1984, pp. 148–149, "High Energy Product Nd-Fe-B Permanent Magnets", by Croat et al.

*Primary Examiner*—John P. Sheehan

*Attorney, Agent, or Firm*—Kenyon & Kenyon

[57] ABSTRACT

A metal part, which may be an amorphous metal, is formed from an intermediate product comprised of at least two alloy components in powder form which have been compacted and optionally deformed such as by hammering or extrusion. The intermediate part is transformed into the metal part by a diffusion reaction. The intermediate product is produced by milling the at least two starting alloy components to form a mixture powder of particles having a predominantly layer-like structure comprising the starting alloy components. At least one of the starting alloy components is magnetic. After milling, the produced mixture powder is subjected to a magnetic field which aligns the still mobile powder particles. Thereafter, the final compacting and possible deformation takes place.

26 Claims, No Drawings

METHOD OF PRODUCING A METALLIC PART

FIELD OF THE INVENTION

This invention relates to a method of producing a metallic part, preferably an amorphous metal or metallic glass part, wherein an intermediate product comprising at least two starting components in powder form with at least one such component being magnetic is made by performing a compacting operation such that the alloying components in the intermediate product each extend a maximum of about 1 μm in at least one direction. The intermediate product is transformed into the metallic part by means of a diffusion reaction at a predetermined elevated temperature.

BACKGROUND OF THE INVENTION

Such a method of producing an amorphous alloy has been discussed e.g. in *Frankfurter Zeitung: Blick durch die Wirtschaft* (published by "Frankfurter Allgemeine Zeitung"), Vol. 27, No. 23, Feb. 1, 1984, page 5, and in *Machine Design*, Vol. 55, No. 25, Oct. 10, 1983, page 8.

Amorphous metals sometimes called "metallic glasses" are generally known. See, e.g., *Zeitschrift Fur Metallkunde*, Vol. 69, 1978, No. 4, pages 212 to 220 or *Elektrotechnik und Maschinenbau*, Vol. 97, September 1980, No. 9, pages 378 to 385. These materials generally involve specific alloys which can be produced by special methods from at least two predetermined starting elements or compounds called alloying components. Often, the material of at least one of the starting elements or compounds is magnetic. Instead of a crystalline structure, these special alloys have a glasslike amorphous structure. Amorphous metal alloys have a number of extraordinary properties or combinations of characteristics such as great wear and corrosion resistance, great hardness and tensile strength and at the same time are ductile as well as having special magnetic properties. In addition, microcrystalline materials with interesting properties can be produced via the detour of the amorphous state. See, e.g., DE-PS No. 28 34 425.

To date, metallic glasses are generally produced by rapid quenching from the molten state. See also DE-OS Nos. 31 35 374 or 31 28 063. However, this method leads to at least one dimension of the material produced being smaller than about 0.1 mm. It would be desirable for various applications, however, if metallic glasses were available in any shape or size.

It has also been suggested to produce metallic glasses by a special solid state reaction instead of by rapid quenching. This requires the rapid diffusion of one of the alloy components into the other below the crystallization temperature of the metallic glass to be produced, while the other component remains practically immobile. Such a diffusion reaction is generally called an anomalous, rapid diffusion. Certain thermodynamic conditions must be met. See, e.g., *Physical Review Letters*, Vol. 51, No. 5, August 1983, pages 415 to 418 or *Journal of Non-Crystalline Solids*, Vol. 61 and 62, 1984, pages 817 to 822. For instance, the mutual reaction of the alloy components must be exothermal. Furthermore, a certain microstructure is required because the alloy components involved are closely adjacent and have, in at least one dimension, very small dimensions extending less than 1 μm. Accordingly, layered structures are especially suitable which can be produced, e.g. by vapor deposition. See, e.g., the previously cited literature in *Phys. Rev. Letters*, Vol. 51. In addition, a lamination of thin metal foils is also possible. See, e.g., *Proc. MRS Europe Meeting on Amorphous Metals and Non-Equilibrium Processing*, published by M. von Allmen, Strasbourg, 1984, pages 135 to 140.

In addition, a similar layer-like (statified) structure can also be obtained by the method described in the previously cited publication *Blick durch die Wirtschaft*. According to this method, appropriate metal powders of the desired composition are first mixed as alloy components and are then compacted to form an intermediate product. This intermediate product, in which the alloy components each extend a maximum of 1 um in at least one dimension, is subsequently transformed into the desired metallic part having an amorphous structure by anomalous, rapid diffusion at a predetermined elevated temperature.

Whereas only very thin structures can be obtained by the vapor deposition method, the two deformation methods mentioned require good ductility of the alloy components involved. In addition, in the known method using powdery alloy components there is the difficulty of having to remove, by the deformation, oxide films on the surface of the metal powders and the structure resulting from the compaction and deformation is very irregular. Furthermore, when studying technically interesting alloys, it will be often found that one of the alloy components is difficult to deform or is virtually undeformable, such as boron of FeNiB or cobalt of CoZr. Also, some components are not available in foil form, or if so, only at a high price, such as rare-earth metals for amorphous transition metal/rare-earth compounds.

For the mass production of metallic parts having a relatively extended shape and size, also using in particular hard to deform or brittle alloy components, a method may be used which is disclosed by unpublished German Patent Application No. P 35 15 167.6 (U.S. patent application Ser. No. 848,984 now U.S. Pat. No. 4,710,236). According to this method, there is first produced, in a powder mill by means of a milling operation known per se, from the usually crystalline powders of the starting elements or compounds representing the alloy components, a mix powder whose individual particles are structured roughly in layers of the starting elements or compounds. The time to conclude the milling process, at which this structure of the particles of the mix, powder is present, can be determined without difficulty by experimental investigations and can thus be specified. The mix powder mix thus produced is then compacted and/or deformed in another operation to form a compact intermediate product of the shape and size matching the desired part. This compact intermediate product still comprises the crystalline particles of the starting elements or compounds with their respective dimensions being less than 1 μm or even less than 0.2 μm, at least in one dimension. A diffusion annealing step follows in which the intermediate product is transformed, in a manner known per se, into the desired metallic part of the amorphous alloy or metallic glass.

In this method, the powder is preferably compacted either by extrusion or by other deforming methods such as hammering. This deformation causes a reduction of the individual layer thicknesses, if the layers are parallel to the deformation direction. While the milling operation produces powder particles with layers largely arranged parallel, the compaction provides no particle alignment so that the arrangement of the individual layers is statistically distributed as to the deformation direction. For layers oriented perpendicular to the deformation direction, there may even result a greater layer thickness during the deformation. Layers predominantly parallel to the deformation direction become thinner while being deformed. The statistically oriented alignment of the layers prior to the compaction thus possibly leads to an increase in the band width of the layer thicknesses after deformation; i.e., the deformation during the compaction is not being utilized.

OBJECTS AND SUMMARY OF THE INVENTION

It is an object of the present invention to provide an improved method for producing a metallic part, particularly an amorphous metal metallic part, from compacted powders of at least two starting alloy components which are subjected to a diffusion reaction. The metallic parts produced by the method of the present invention can be of relatively extended size and shape and can be mass produced. The method of the present invention can be practiced using hard to deform and brittle alloy components.

In accordance with the present invention, the alloy components in powder form are subjected to a magnetic field so that the individual layers in the compacting operation are arranged parallel to a predetermined preferred direction. Accordingly, at least one of the starting alloy components is a magnetic material. The predetermined preferred direction is the direction of deformation. The compacted and deformed alloy components are then subjected to a diffusion reaction at a predetermined elevated temperature to form the metallic part which in preferred embodiments is an amorphous metal.

In accordance with the advantages of the invention, the particles of the mix powder align themselves in an applied magnetic field of sufficient strength so that their layer-like structures are approximately parallel to the magnetic field. During the manufacturing process, the magnetic field is applied at least at a time when the individual particles are still mobile, i.e., generally at least prior to the actual compacting operation. Due to the special alignment of the individual, layer-like structures of the mix powder in the magnetic field, the layer-like structures become even thinner during the deformation. This means that the deformation process for compacting is also utilized for a further reduction of the layer thicknesses. As is known, diffusion reactions between the particles are promoted by suitably thin layer thicknesses. This is of particular advantage when it is intended to produce an amorphous material from the alloy components.

DETAILED DESCRIPTION

The invention is explained in greater detail by way of an illustrative embodiment for the production of a metallic glass part. Not all of the at least two powdery alloy starting components need necessarily be metallic. Some of the powdery alloy components may be metalloids. But at least one of the powdery alloy starting components must have magnetic properties. The starting alloy components will generally be crystalline; however, in cases using metalloids, amorphous powders such as of boron may also be used.

The metallic glass of the part to be produced may be, e.g., a binary composition $A_xB_y$, A and B being, e.g., metallic starting elements or alloy components, and x and y being atom percentages (with $x+y=100$). One of the alloy starting components A or B should comprise a magnetic material. According to one concrete embodiment example, A may be, e.g., magnetic Co and B non-magnetic Zr. Other appropriate starting components may be also used for the formation of known amorphous, or also non-amorphous, alloys of two or more components.

According to the example of a binary alloy, powders of the two components A and B, together with hardened steel balls, are first placed into a suitable milling cup. The grain size of the powders may be random, but a similar grain size distribution for both components involved is advantageous. The resultant atomic concentration of the part to be produced from these powders is determined by the quantitative proportion of the two types of powder employed.

Accordingly, pure Co and Zr powders of grain sizes of, e.g., about 40 μm in the average, may be placed in a planetary ball mill (for example, a Fritsch: Type "Pulverisette-5"), with the steel balls being 10 mm in diameter. A variation of the diameter and the number of the balls causes any desired variation of the milling intensity. To prevent surface oxidation of the particles, the steel container of the mill is closed under a protective gas atmosphere such as argon. It is reopened only after the conclusion of the milling operation. During the milling operation, the powders are squashed, welded together and also divided again. Advantageously, a predetermined temperature level below the crystallization temperature of the amorphous material to be formed may be maintained. If applicable, several temperature levels may be provided, or an appropriate temperature program may be run. As the milling continues, larger powder particles originate which have, at least to a great extent, a layer-like structure, i.e. they comprise a multiplicity of alternating, layer-like areas of the alloy components involved. This involves a microstructure such as also originates in the initial phase of a known mechanical alloying process. See e.g. *Scientific American,* Vol. 234, 1976, pages 40 to 48. It is possible to produce amorphous alloys by this known process. See, e.g., *Applied Physics Letters,* Vol. 43, No. 11, Dec. 1, 1973, pages 1017 to 1019. However, while in the known mechanical alloying process milling continues until the above mentioned layer-like structure dissolves again and a genuine alloy originates, the milling operation is stopped in the method according to the invention upon the attainment of the desired layer-like structure with the layer-like areas generally being about 0.01 to 0.9 μm thick, and preferably between about 0.05 and 0.5 μm thick. The size of the powder particles themselves adjusts to about 10 to 200 μm in diameter and preferably about 20 to 100 μm in diameter. The predetermined time when this desired powder particle structure is present can be determined, e.g., by examining sections of the particles. Thus, there is at the end of the milling operation, which is stopped at this point in time, a mix powder whose particles comprise alternating, thin, crystalline, layer-like areas and which still has sufficient mobility of the powder particles to be aligned in a magnetic field and sufficient ductility for a compacting operation ultimately to be performed.

As long as the powder particles are still mobile, they can be subjected to an advantageously constant magnetic field, according to the invention. The powder particles align themselves so that their layer-like structures are parallel to the magnetic field. The direction of the magnetic field is such as to coincide with a later compacting or deforming direction.

The manner in which the magnetic alignment of the powder particles takes place depends on the respective compacting method. For instance, if a so-called isostatic pressing method is used, either in connection with a simultaneous diffusion annealing as hot isostatic pressing, or for the formation of a workable part for further deformation by extruding, hammering or the like, the mix powder is first filled into a deformable mold. The magnetic field is subsequently applied parallel to the longitudinal axis of the mold, possibly with shaking and knocking. The magnetic field strength may range between 0.1 and 1 T. After the individual layers of the powder particles have thus been aligned parallel to the magnetic field direction, the magnetic field can be turned off, the mold closed, and the isostatic pressing operation started. The pressed blank must be handled with care so that the powder does not rearrange itself.

Another possibility is to compact the powder first in a single-axis press to form a compact pre-product or several tablet-like moldings. After the pre-product or the moldings has (have) been jacketed, if applicable, another deforming operation such as extruding or hammering may follow. The magnetic field should be applied after the mix powder has been filled into the press die and prior to the pressing operation. Alternatively, the mix powder can be filled directly into a jacket, magnetically aligned, and subsequently extruded, hammered or the like in the jacket for a good compaction.

It was assumed in the previous example of the present invention chosen that only one of the two alloy components A or B comprised a magnetic material. However, both components can be magnetic. This means, however, that, in general, different Curie temperature $T_c^a$ or $T_c^b$ of the two components A and B are present. In this case, the inventive magnetic alignment of the produced powder particles is advantageously performed in a magnetic field at a temperature T between the two Curie temperatures, which means: $T_c^a < T < 21\ T_c^b$ if $T_c^a < T_c^b$ (otherwise vice versa).

At the conclusion of a possibly further shaping operation, an intermediate product of the part to be produced is present which has the desired shape and size. A heat treatment then follows in which the interdiffusion of the alloy components involved takes place as a solid-state reaction, which interdiffusion is responsible for the amorphization. While this reaction may possibly proceed as anomalous, rapid diffusion in known manner, in which one alloy component diffuses into the other, other diffusion reactions with, e.g., mutual infusion of the components are also just as well possible. It must be noted that in all of these reactions, the finer the structure, lower temperatures and shorter annealing times suffice for the complete transformation of the intermediate product into the desired part. In any event, the annealing temperature must, in a known manner, be below the crystallization temperature of the metallic glass for this solid-state diffusion reaction. The metallic part obtained as the end product upon the conclusion of this method comprises an amorphous alloy, and its thickness and shape are predetermined by the compacting method, and therefore arbitrarily selectable within wide limits.

It was assumed in the above described embodiment example of the method according to the invention that a metallic glass or amorphous metal part is to be produced. It is just as well possible to produce by the method of the present invention parts from crystalline metal mix powder which remain crystalline after a diffusion annealing. The crystalline metal part can also be obtained via the detour of a non-crystalline, amorphous structure. See e.g. *Applied Physics Letters,* Vol. 44, No. 1, January 1984, pages 148 and 149. That is, an amorphous metal part is first produced according to the method of the present invention. In a subsequent annealing process, this amorphous metal part is crystallized, e.g., into a part having a microcrystalline structure.

Although preferred embodiments of the present invention have been described in detail, it is contemplated that modifications will be made by those skilled in the art within the spirit and the scope of the present invention as defined in the claims.

What is claimed is:

1. In a method for manufacturing a metallic part including the steps of:

forming an intermediate product of at least a first alloy component in powder form and of a second alloy component in powder form wherein at least one of said first and second alloy components has magnetic properties and wherein each alloy component in the intermediate product has at least one dimension of not greater than about 1 um in extent, wherein said step of forming said intermediate product includes a compacting step;

and transforming the intermediate product into a metal alloy part by a diffusion reaction at a predetermined elevated temperature;

the improvement comprising:

producing a crystalline mixture powder by milling a mixture of at least said first alloy component powder and said second alloy component powder and terminating the milling at a time at which the particles of the produced mixture powder are formed of a predominantly layer-like structure of the alloy components each layer of said layer-like structure having a thickness of said dimension of not greater than 1 $\mu$m;

thereafter subjecting the produced particles of the mixture powder to a magnetic field at a time when the powder particles have mobility thereby aligning the powder particles by said magnetic field with the direction of said magnetic field coinciding with the direction of said compacting;

ultimately effecting said compacting step by compacting and deforming the produced mixture powder of particles aligned by said magnetic field to form said intermediate product having a predetermined shape.

2. A method according to claim 1 wherein said intermediate product is produced by a further deformation step.

3. A method according to claim 1 wherein said metal alloy part produced by said diffusion reaction has an amorphous structure.

4. A method according to claim 2 wherein said metal alloy part produced by said diffusion reaction has an amorphous structure.

5. A method according to claim 1 wherein the termination time of milling is determined by sectional examination of the particles of the produced mixture powder.

6. A method according to claim 1 wherein the milling takes place under a protective gas atmosphere.

7. A method according to claim 1 wherein the milling takes place at least at one predetermined temperature.

8. A method according to claim 1 wherein said predominantly layer-like structures each have a thickness of from about 0.01 μm to about 0.9 μm.

9. A method according to claim 8 wherein said predominantly layer-like structures each have a thickness of from about 0.05 μm to about 0.5 μm.

10. A method according to claim 1 wherein said particles of said produced mixture powder have diameters from about 10 μm to about 200 μm.

11. A method according to claim 10 wherein said particles of said produced mixture powder have diameters from about 20 μm to about 100 μm.

12. A method according to claim 1 wherein said magnetic field has a strength between about 0.1 to about 1 Tesla.

13. A method according to claim 1 wherein said produced mixture powder is subjected to a shaking or knocking treatment when said magnetic field is applied.

14. A method according to claim 1 wherein said produced mixture powder is deformed into said intermediate product by hammering.

15. A method according to claim 1 wherein said produced mixture powder is deformed into said intermediate product by extrusion.

16. A method according to claim 1 wherein said diffusion reaction takes place after the last compacting.

17. A method according to claim 2 wherein said diffusion reaction takes place after a last deformation step.

18. A method according to claim 1 wherein said diffusion reaction is performed simultaneously with the last compacting.

19. A method according to claim 2 wherein said diffusion reaction is performed simultaneously with the last deformation.

20. A method according to claim 1 wherein two magnetic alloy components having different Curie temperatures are provided and said aligning of the powder particles by said magnetic field takes place at a temperature intermediate said different Curie temperatures.

21. A method according to claim 1 wherein a noncrystallyne, structure of said intermediate product is transformed to a microcrystalline structure by a predetermined annealing step.

22. A method according to claim 1 wherein said intermediate product is formed from at least two crystalline alloy components.

23. A method according to claim 1 wherein at least one alloy component is metallic and at least another alloy component is a metalloid.

24. A method according to claim 23 wherein said metalloid alloy component is amorphous boron.

25. A method according to claim 1 wherein the intermediate product is formed from at least three alloy components.

26. A method according to claim 1 wherein at least one of the alloy components forming the intermediate product is a compound or alloy comprised of several chemical elements.

* * * * *